US011523667B2

(12) United States Patent
Walker

(10) Patent No.: US 11,523,667 B2
(45) Date of Patent: Dec. 13, 2022

(54) MULTIPURPOSE CARRIER WITH COMPARTMENT FOR WESTERN HAT

(71) Applicant: HATPAC, LLC, Manhattan Beach, CA (US)

(72) Inventor: Charles Brent Walker, Manhattan Beach, CA (US)

(73) Assignee: HatPac, LLC, Manhattan Beach, CA (US)

( * ) Notice: Subject to any disclaimer, the term of this patent is extended or adjusted under 35 U.S.C. 154(b) by 369 days.

(21) Appl. No.: 16/601,036

(22) Filed: Oct. 14, 2019

(65) Prior Publication Data

US 2021/0106108 A1 Apr. 15, 2021

(51) Int. Cl.
*A45C 11/02* (2006.01)
*A45C 13/10* (2006.01)
*A45C 13/02* (2006.01)

(52) U.S. Cl.
CPC ..... *A45C 11/02* (2013.01); *A45C 13/02* (2013.01); *A45C 13/103* (2013.01)

(58) Field of Classification Search
CPC ..... A45C 11/02; A45C 13/02; A45C 13/103; A45F 3/04
USPC ..... 206/8, 292
See application file for complete search history.

(56) References Cited

U.S. PATENT DOCUMENTS 66,880 A * 7/1867 Packer ..... A45C 11/02 206/8
160,680 A * 3/1875 Jaeger ..... A45C 11/02 206/8
573,789 A * 12/1896 Lyons ..... A45C 11/02 206/8
657,061 A * 8/1900 Cannan ..... A45C 11/02 206/8
870,550 A * 11/1907 Dod ..... A45C 11/02 206/8
1,458,638 A * 6/1923 Bogley ..... A45C 11/02 206/8
1,520,932 A * 12/1924 Comstock ..... A45C 11/02 206/8
1,743,838 A * 1/1930 Walinsky ..... A45C 11/02 206/289
1,784,333 A * 12/1930 Bruer ..... A45C 11/02 206/8

(Continued)

FOREIGN PATENT DOCUMENTS

GB 2464957 A * 10/2008 ..... A45F 5/06
GB 2464957 5/2010

OTHER PUBLICATIONS

Hat Box: (https://www.amazon.com/Hat-Box-Travel-Luggage-Shoulder/dp/B07L4ZSCFF/ref) (Year: 2018).*

*Primary Examiner* — Valentin Neacsu
*Assistant Examiner* — Justin Caudill
(74) *Attorney, Agent, or Firm* — Mark Young, PA

(57) ABSTRACT

A cowboy hat carrier compartment is defined by a substantially rigid base and cover. The cover may be opened with a zipper, buckle or latch. The hat compartment contains a rigid tray on which the hat is stored. The tray includes a frustum-shaped mandrel that is sized, shaped and positioned to fit into the dome of the hat. The tray also includes a pan for supporting the brim of the hat. The front of the pan includes a recess sized and shaped to receive a dipped front of the brim of the cowboy hat.

17 Claims, 11 Drawing Sheets

(56) References Cited

U.S. PATENT DOCUMENTS

| | | | | | |
|---|---|---|---|---|---|
| 2,324,366 | A * | 7/1943 | Creper | A45C 11/02 206/9 |
| 2,586,700 | A | 2/1952 | Noble | |
| 3,324,994 | A | 6/1967 | Rauser | |
| 3,479,106 | A * | 11/1969 | Bohannon | A47F 7/065 312/351 |
| 4,881,637 | A * | 11/1989 | Peters | A45C 3/12 206/278 |
| 5,022,515 | A | 6/1991 | Agostine | |
| 5,074,410 | A | 12/1991 | Fries et al. | |
| 5,480,023 | A | 1/1996 | Puller | |
| 5,823,328 | A * | 10/1998 | Fomby | A45C 11/02 206/8 |
| D544,207 | S | 6/2007 | Lindars | |
| 8,573,373 | B2 * | 11/2013 | Rothschild | B65D 3/04 190/107 |
| 9,706,824 | B2 | 7/2017 | Tuning | |
| 2005/0051404 | A1 * | 3/2005 | Chi | A45C 7/0036 190/107 |
| 2005/0002115 | A1 | 9/2005 | Reeve | |
| 2016/0213132 | A1 * | 7/2016 | Ford | A45F 3/02 |
| 2017/0012777 | A1 | 5/2017 | Tuning | |
| 2018/0279744 | A1 * | 10/2018 | Tong | A45F 3/04 |

* cited by examiner

MULTIPURPOSE CARRIER WITH COMPARTMENT FOR WESTERN HAT

FIELD OF THE INVENTION

This invention relates generally to a hat carrier, and, more particularly, to baggage or luggage that includes a compartment for safely storing a cowboy hat.

BACKGROUND

A cowboy hat is one of the most beloved items of western wear. It is a very personal, and often very expensive, item. Traveling with such an item can be complicated. The hat cannot be worn while seated in a seat with a high back. The hat cannot be stored in conventional luggage without risk of damage. Placing the hat on one's lap also risks damage.

Heretofore, many owners of cowboy hats stored their hat in a carrier while traveling. The carrier, known as a hat can, has a clam-shell design, with a bottom, a hinge and a top, and the hinge connecting the bottom to the top. Such carriers also include a carrying handle, as well as buckles or latches for locking. The handle is positioned at the top near the center of the carrier. The bottom and top are generally rigid and define an interior space that contains the hat. Thus, the hat is shielded from forces that could otherwise crease and compress the hat out of shape.

Problems with known hat cans are that they are standalone carriers and that they are awkward to carry by the handle. Such hat cans are cumbersome and tend to strike a person's leg when carried while walking. As standalone carriers, they must be carried separately and constitute another piece of luggage in air travel. Today, this means additional airline fees.

Additionally, while many hat cans include a dome-like support on which the hat rests, if the brim reaches the bottom of the hat can, they do nothing to preserve the complex shape of the brim. A brim of a typical cowboy hat includes a dipped front (i.e., front bent lower than the back) and upturned sides. If the brim reaches the bottom of the can, the unique shape of the brim, including the dipped front of the brim, may be compromised.

An improved carrier for cowboy hats is needed. The improved carrier should not be a standalone carrier, should be easy to carry, and should protect both the dome and brim from deformation during storage and travel.

The invention overcomes one or more of the problems and solves one or more of the needs as set forth above.

SUMMARY OF THE INVENTION

To solve one or more of the problems set forth above, in an exemplary implementation of the invention, a hat carrier, and, more particularly, a multipurpose bag or luggage that includes a compartment for safely storing a cowboy hat is provided. By way of example and not limitation, the bag may be a backpack, duffel bag, a roller bag or other type of luggage or suitcase. The bag includes multiple compartments, including at least one compartment (hat compartment) for storing a cowboy hat.

The hat compartment includes a substantially rigid outer cover and a substantially rigid base. The outer cover is attached along an edge with a hinge, flexible sheet or the like, allowing the outer cover to pivot about the edge between an opened and closed position. A zipper or other closure secures the outer cover in the closed position relative to the base. The outer cover and base define an interior volume that is sized and shaped to hold a tray and the cowboy hat.

The hat compartment contains a tray on which the cowboy hat is stored. The tray is substantially rigid. The tray includes a frustum-shaped mandrel (hollow, but can be solid) that is sized and positioned to fit into the dome of the hat when the hat is stored in the hat compartment. The tray also includes a pan for supporting the brim of the hat. The front of the pan includes a recess sized and shaped to receive a dipped front of the brim of the cowboy hat.

The recess protects the front of the brim from deflection and damage. By providing a compartment in which the front of the brim is received, the recess allows the hat to maintain its shape.

Optionally, a frictional resilient material may cover all or part of the exterior surface of the mandrel that is received in the dome of the hat. By way of example, the material may comprise a foam sleeve applied over the mandrel, or one or more foam bands around the mandrel. Alternatively, such sleeve or bands may comprise silicone or another resilient material.

The tray may be permanently attached to the base of the hat compartment. Alternatively, the tray may be releasably attached (e.g., using hook and loop fasteners, snaps, a zipper, or magnets) to the base. As another alternative, the tray may be stored in the compartment, but not in any way attached to the base.

When the hat is stored on the tray in the closed hat compartment, the hat is disposed between the tray and the outer cover. The recess of the tray protects the dipped front of the brim of the hat while the hat is stored on the tray. The hat compartment may be opened by unzipping (or otherwise releasing) the zipper (or other closure). When the outer cover is pivoted to an open position, the interior of the hat compartment may be accessed to store or remove a hat.

BRIEF DESCRIPTION OF THE DRAWINGS

The foregoing and other aspects, objects, features and advantages of the invention will become better understood with reference to the following description, appended claims, and accompanying drawings, where:

Those skilled in the art will appreciate that the figures are not intended to be drawn to any particular scale; nor are the figures intended to illustrate every embodiment of the invention. The invention is not limited to the exemplary embodiments depicted in the figures or the specific components, configurations, shapes, relative sizes, ornamental aspects or proportions as shown in the figures.

DETAILED DESCRIPTION

Figure 1:
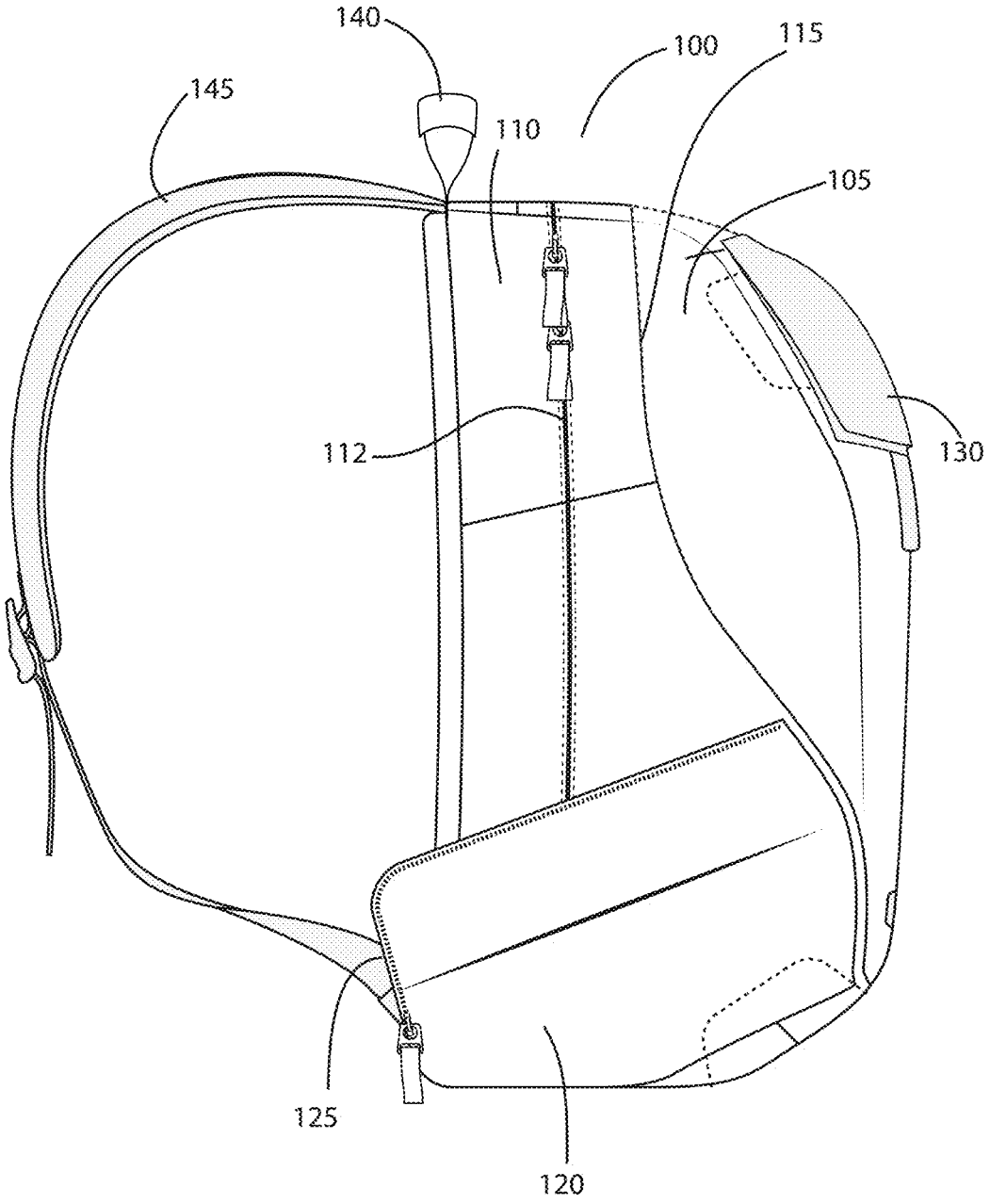
FIG. 1 is a first side view of an exemplary backpack having a plurality of storage compartments, including an exemplary hat compartment according to principles of the invention.
Figure 2:
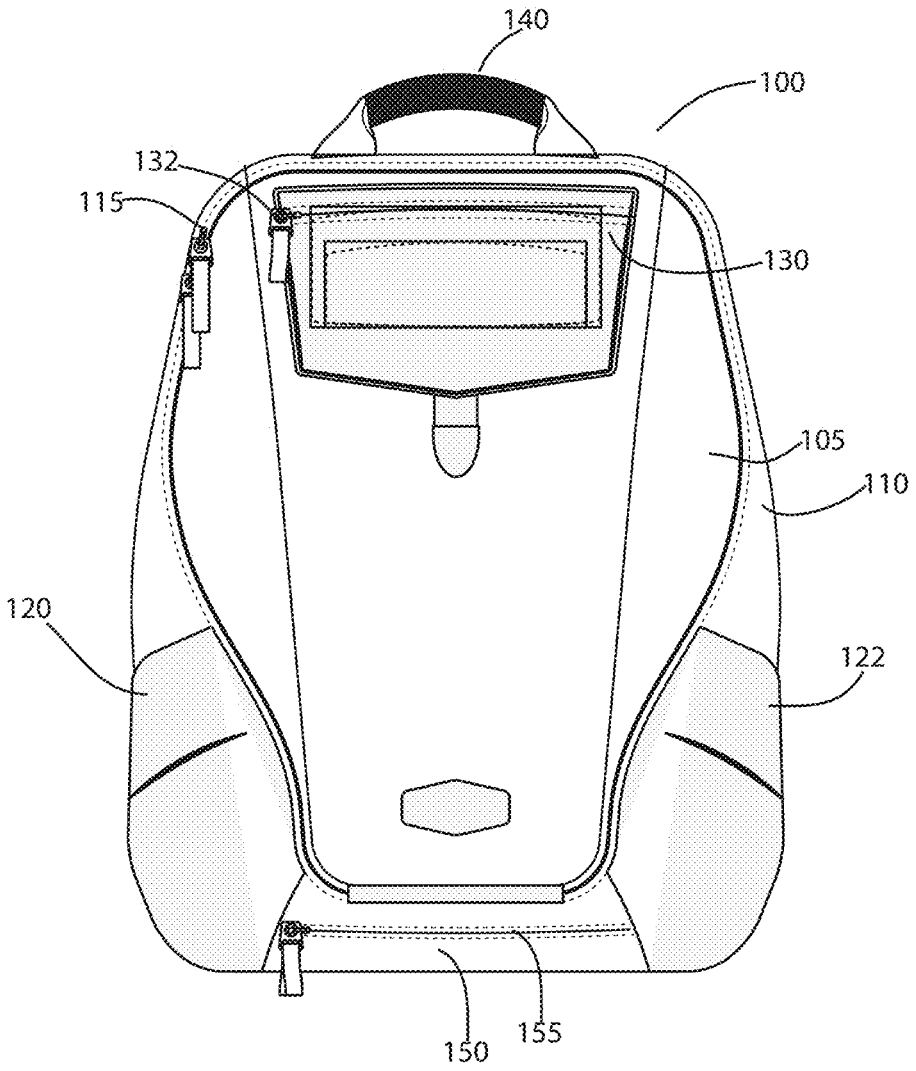
FIG. 2 is a front view of an exemplary backpack having a plurality of storage compartments, including an exemplary hat compartment according to principles of the invention.
Figure 3:
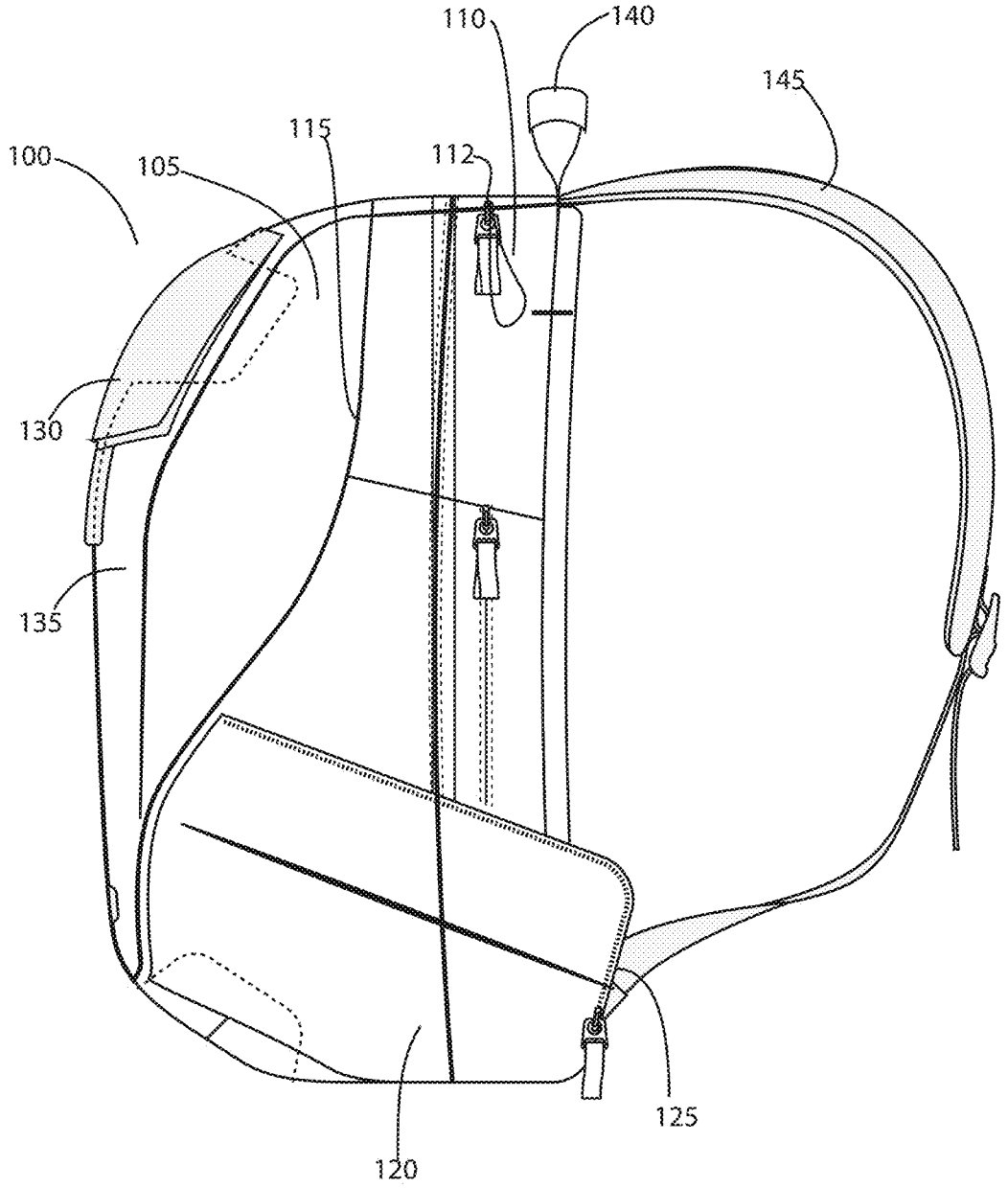
FIG. 3 is a second side view of an exemplary backpack having a plurality of storage compartments, including an exemplary hat compartment according to principles of the invention.

With reference to FIGS. 1 through 3, an exemplary backpack 100 having a plurality of storage compartments, including an exemplary hat compartment according to principles of the invention, is conceptually illustrated. By way of example and not limitation, the bag 100 is a backpack. However, the invention may be applied to other baggage, such as a duffel bag, a roller bag or other type of luggage or suitcase. Whatever bag is used, the bag includes multiple compartments, including at least one compartment (hat compartment) for storing a cowboy hat.

The exemplary backpack 100 includes an outer cover 105 for a hat compartment. A zipper 115 defines a substantial portion of the periphery of the outer cover 105. The zipper does not extend across a portion of one edge 116 of the periphery. This edge 116 serves as a hinge. When the zipper 115 is opened, the cover may be opened by bending at the hinge. In a hard case bag, latches or buckles may be used in lieu of a zipper and the hinged edge may comprise a mechanical hinge.

A plurality of pockets and other compartments may be included. By way of example, a cover 130 for a pocket or a small compartment may be provided on the outer side of the outer cover 105 for the hat compartment. A zipper 132 may provide access to the interior of the pocket.

As another example, a cover 150 for a pocket or a small compartment may be provided beneath the hat compartment. A zipper 155 may provide access to the interior of the compartment.

Similarly, pockets and compartments may be provided on the sides of the backpack 100 and beneath the hat compartment. Side compartments 120, 122, may include zipper 125 closures.

Likewise, a compartment 110 may be provided behind the hat compartment. The interior of the compartment 110 may accessible through another zipper closure 112 that extends across the top and a portion of a side of the backpack 100.

Figure 4:
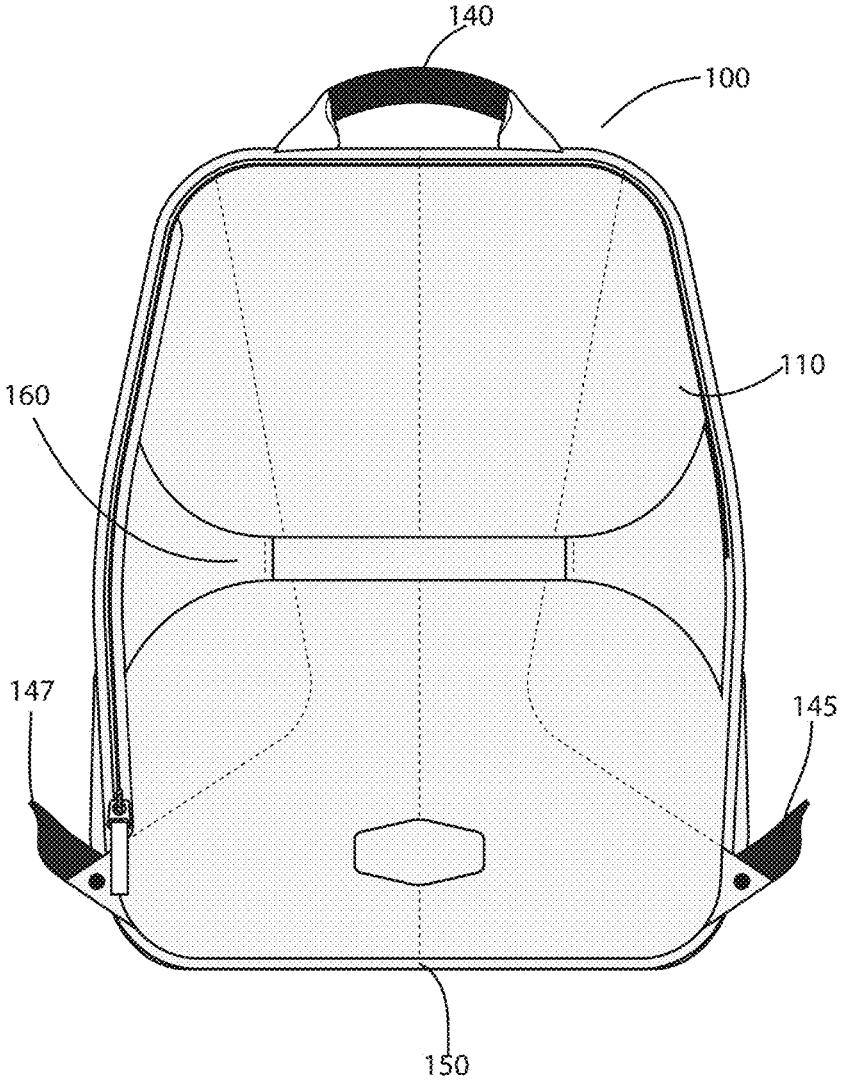
FIG. 4 is a back view of an exemplary backpack having a plurality of storage compartments, including an exemplary hat compartment according to principles of the invention.

To facilitate carrying, a handle 140 and shoulder straps 145, 147 may be provided. The handle 140 and straps 145, 147 may be padded and adjustable. The exemplary backpack 100 also includes a trolley strap 160 extending across the back, as shown in FIG. 4. The trolley strap may slide onto a handle of a roller bag. Bags may also be equipped with wheels, a telescopic handle, buckles, and other accessories and closures known in the field of luggage.

The hat compartment includes a substantially rigid outer cover 105 and a substantially rigid base to which the outer cover attaches when closed. The outer cover 105 and base define an interior volume that is sized and shaped to hold a tray 200 and the cowboy hat.

Figure 5:
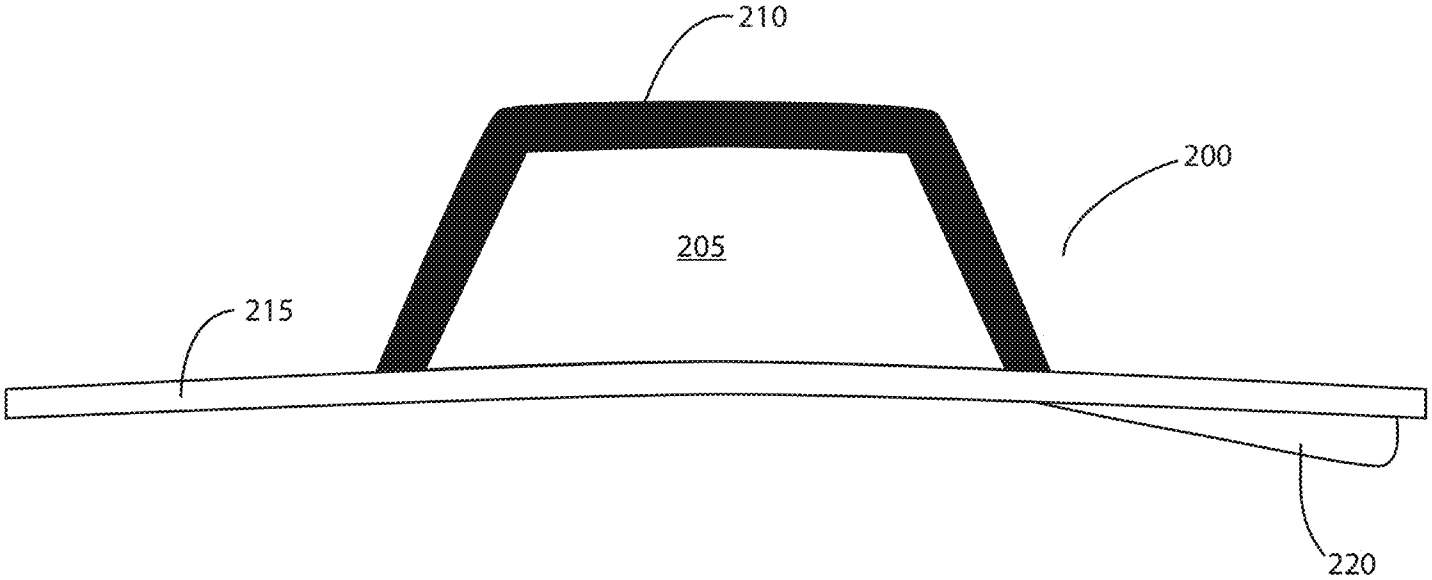
FIG. 5 is a side view of an exemplary tray for a hat compartment according to principles of the invention.
Figure 6:
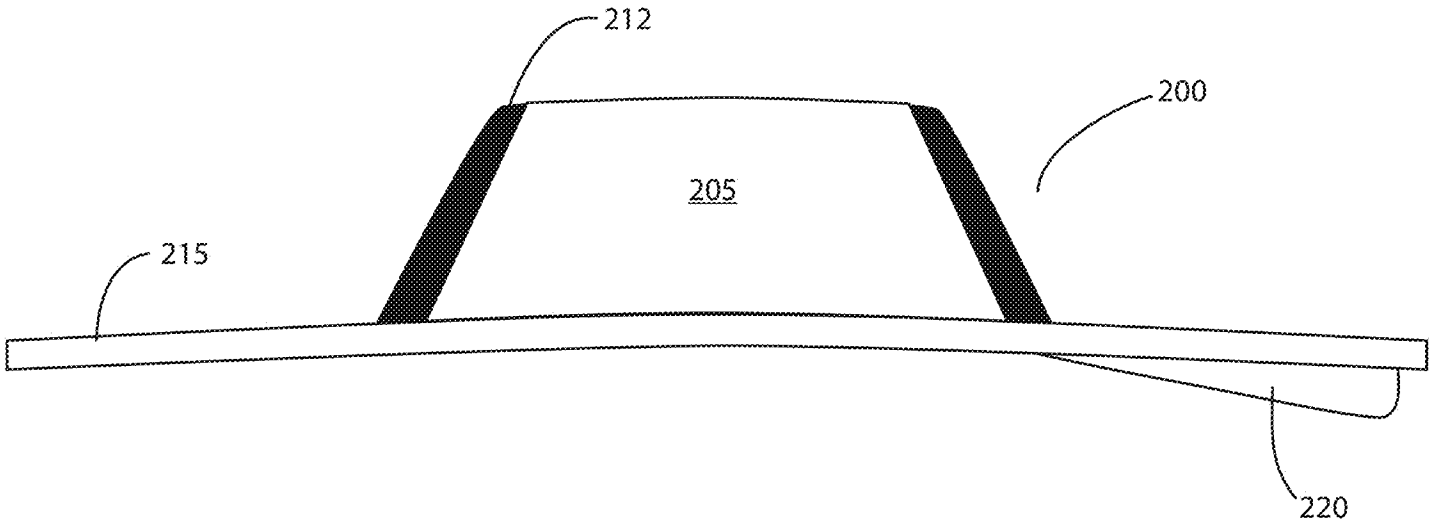
FIG. 6 is a side view of another exemplary tray for a hat compartment according to principles of the invention.

FIG. 5 provides a side view of an exemplary tray 200 for a hat compartment according to principles of the invention. The hat compartment contains a tray 200 on which the cowboy hat is stored. The tray 200 is substantially rigid. The tray 200 includes a mandrel 205 that is sized, shaped (generally frustum-shaped, but may have a planar top or a curved top) and positioned to fit into the dome of a hat when the hat is stored in the hat compartment. The mandrel is preferably hollow to save material and weight, but could be solid. The tray 200 also includes a pan 215 for supporting the brim of the hat.

Many western hats include a brim with a dipped front.

To accommodate the dip, the front (leading edge) 218, which is opposite the trailing edge 216 of the pan 215 includes a recess 220 sized and shaped to receive the dipped front of the brim of the cowboy hat. The recess 220 is deep and wide enough to receive the dipped front of the brim of the cowboy hat, while the mandrel supports the dome of the hat.

Figures 9, 10, 11:
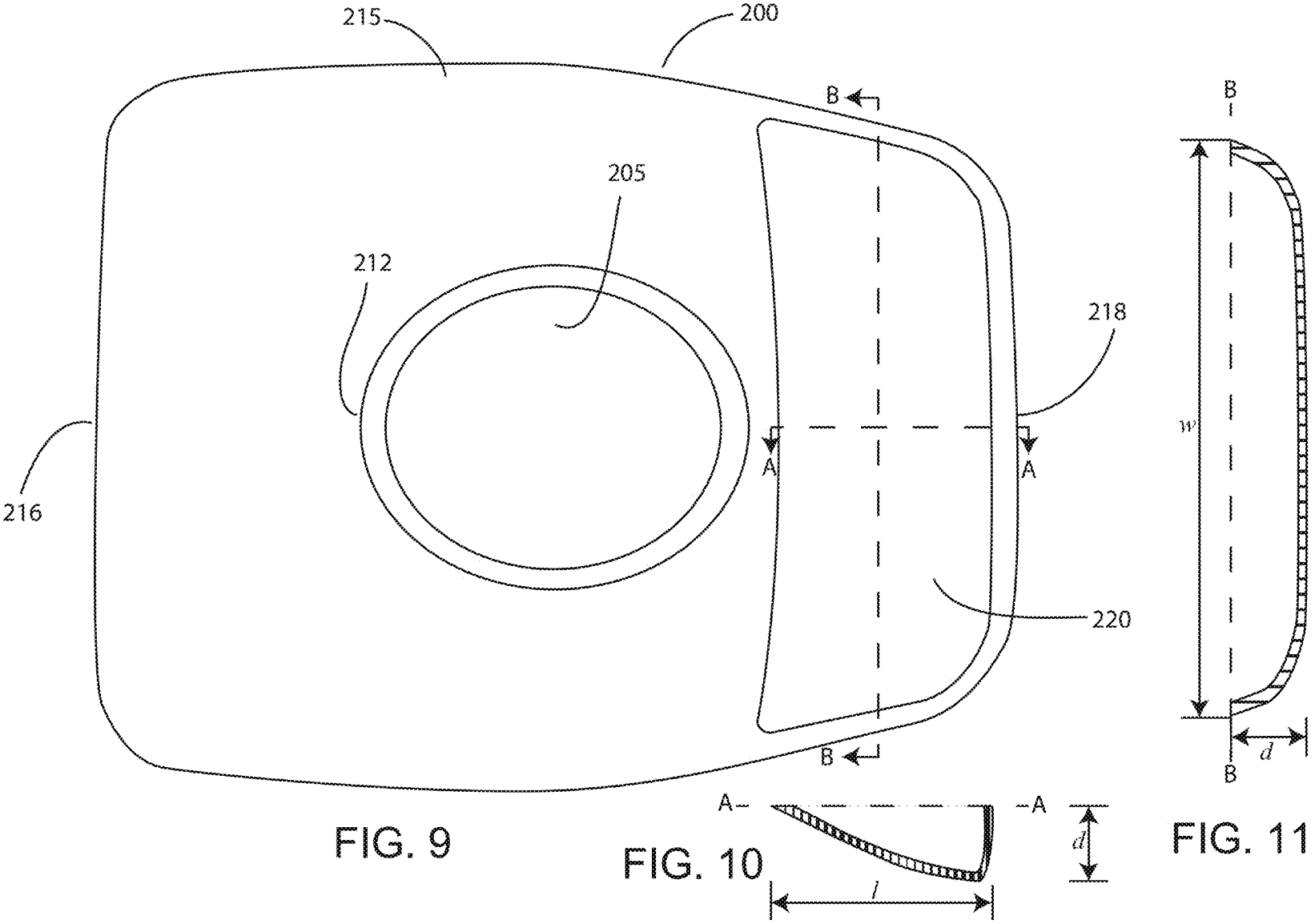
FIG. 9 is a top plan view of an exemplary tray for a hat compartment according to principles of the invention.
FIG. 10 is cross-section A-A of the recessed portion of the exemplary tray of FIG. 9 according to principles of the invention.
FIG. 11 is cross-section B-B of the recessed portion of the exemplary tray of FIG. 9 according to principles of the invention.

With reference to FIGS. 10, 11, in an exemplary embodiment, the maximum depth, d, of the recess 220 below the top of the panel 215 is about 10 to 35 mm, and more preferably about 15 to 25 mm, and even more preferably 18 to 24 mm, and most preferably about 20 to 22 mm. Such a depth accommodates the dip of many cowboy hats.

In an exemplary embodiment, the length, l, of the recess 220 is about 30 to 105 mm, and more preferably about 45 to 90 mm, and even more preferably 50 to 85 mm. Such a length accommodates the dip of many cowboy hats.

In an exemplary embodiment, the width, w, of the recess 220 is about 250 to 400 mm, and more preferably about 300 to 380 mm, and even more preferably 370 to 380 mm. Such a width accommodates the width of the front of many cowboy hats.

While the exemplary embodiment illustrates a recess 220 that gradually reaches the maximum depth, d, towards the front 218 of the tray 200, such a configuration is not required. Rather, the recess may reach the maximum depth, d, towards the opposite side of the recess and maintain that depth to about the edge of the recess adjacent to the front 218 of the tray 215, In an exemplary embodiment, the height of the mandrel 205 is about 65 to 85 mm, and more preferably about 70 to 80 mm, and even more preferably 72 to 78 mm, and most preferably about 73 to 77 mm. Such a height accommodates the dome of many cowboy hats.

In an exemplary embodiment, the maximum diameter of the mandrel 205, without the resilient cover, is about 180 to 220 mm, and more preferably about 190 to 210 mm, and even more preferably 195 to 205 mm, and most preferably about 198 to 202 mm. Such a diameter accommodates the dome of many cowboy hats.

In an exemplary embodiment, the resilient cover 210, 212 has a thickness of at least about 5 to 20 mm.

In an exemplary embodiment, the length of the tray from front to back is about 400 to 500 mm, and more preferably about 450 to 490 mm, and even more preferably 470 to 480 mm. Such a length accommodates the length of many cowboy hats.

In an exemplary embodiment, the width of the tray from side to side is about 325 to 425 mm, and more preferably about 350 to 400 mm, and even more preferably 370 to 380 mm. Such a width accommodates the width of many cowboy hats.

Optionally, a frictional resilient material 210 may cover all or part of the exterior surface of the mandrel 205 that is received in the dome of the hat. By way of example, the material 210 may comprise a foam sleeve applied over the mandrel as conceptually illustrated in FIG. 5. Alternatively, one or more foam bands 212 around the mandrel 205, as conceptually illustrated in FIGS. 6-9. Alternatively, such sleeve 210 or band(s) 212 may comprise silicone or another resilient material. Such material frictionally secures the dome of the hat to the mandrel 205.

Figure 7:
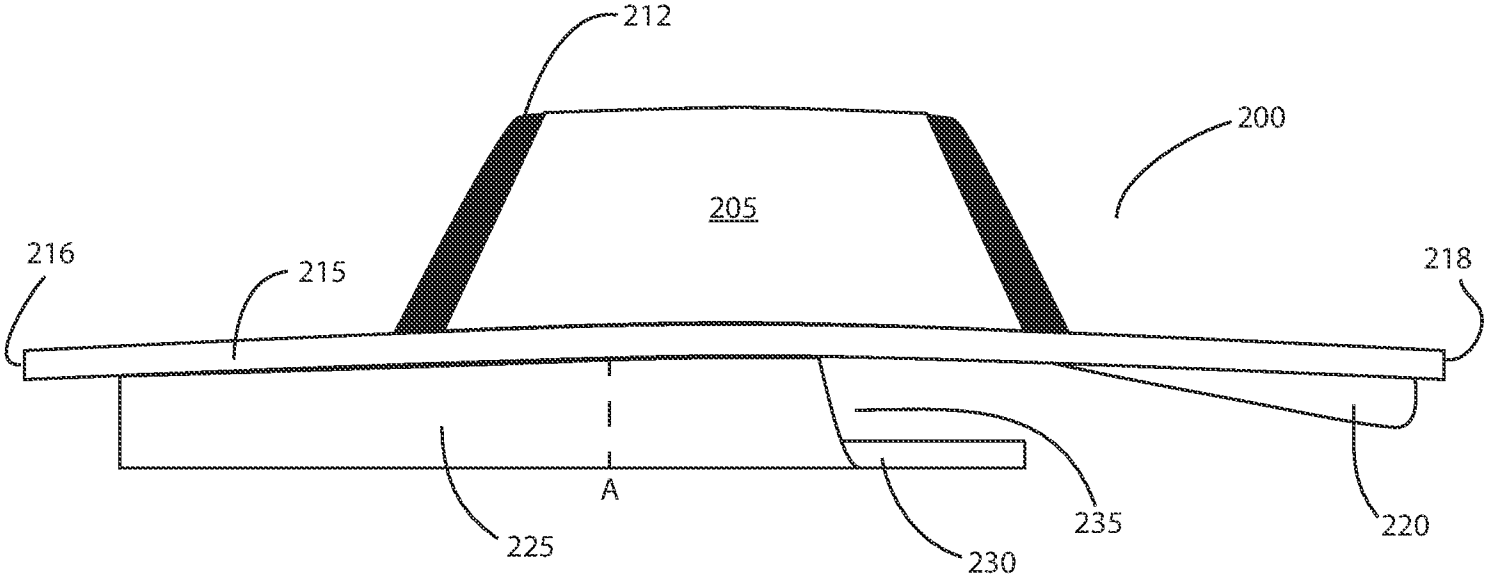
FIG. 7 is a side view of another exemplary tray for a hat compartment according to principles of the invention.
Figure 7A:
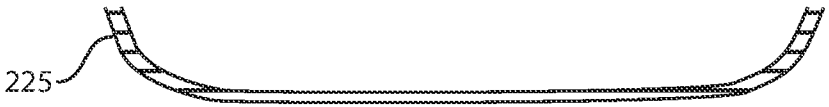
FIG. 7A conceptually illustrates section A of the u-shaped enclosure of the tray for the hat compartment of FIG. 7.
Figure 8:
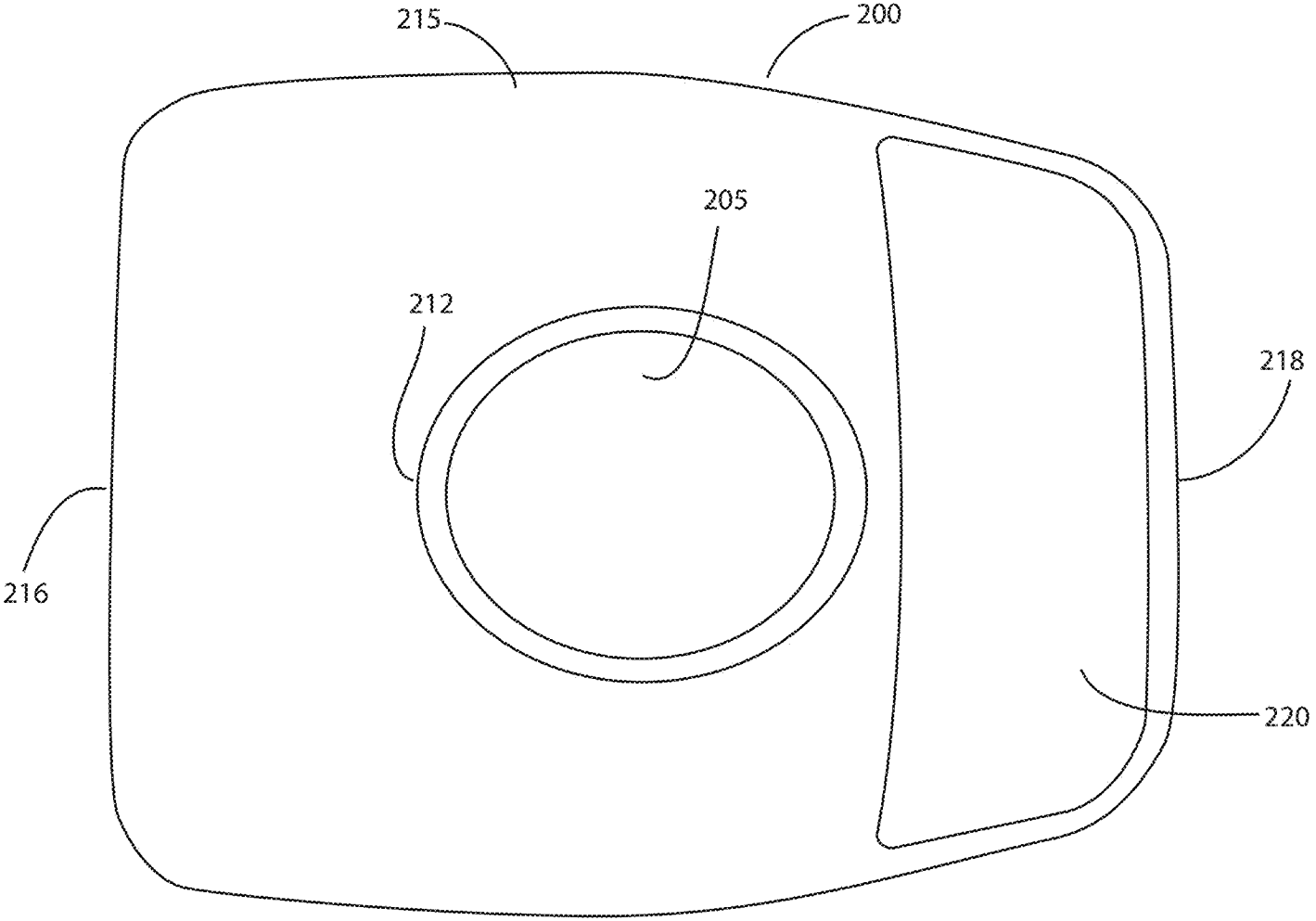
FIG. 8 is a top plan view of an exemplary tray for a hat compartment according to principles of the invention.

In the embodiment of FIG. 7, a storage compartment 235 (e.g., a laptop pocket) is provided below the tray 215. As shown in the section view of FIG. 7A, the storage compartment structure includes a u-shaped (i.e., u-shaped cross-section) enclosure 225 and edge 230 extending from the bottom end of the front of the enclosure 225. The enclosure 225 defines a generally cubic volume comprising the storage compartment. The front and back ends of the u-shaped enclosure 225 may be open, to allow an object such as, papers, files, a laptop, a tablet or the like to be slid into the compartment 235 for storage and protection. The storage compartment may be accessed via zippered closure 112.

The storage compartment structure may be integrally formed with the tray 200, or separately formed and attached to the underside of the tray 200, or separately formed and not attached to the underside of the tray 200. Attachment may be by welding (e.g., ultrasonic welding), bonding or mechanical fastening. The structure may be rigid or flexible.

Figure 13:
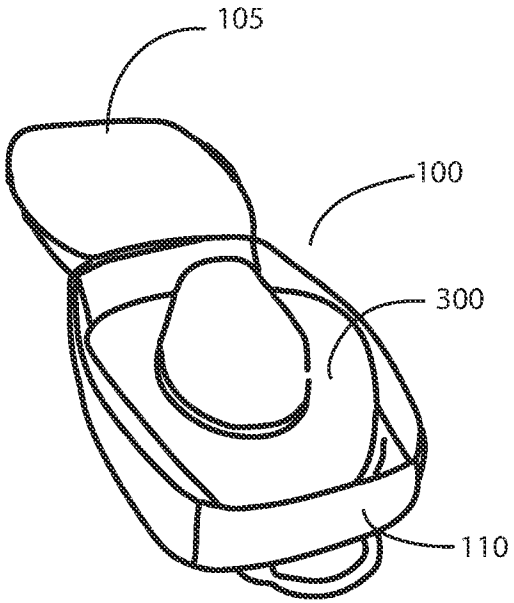
FIG. 13 conceptually illustrates an exemplary backpack with an open hat compartment containing a hat according to principles of the invention.
Figure 12:
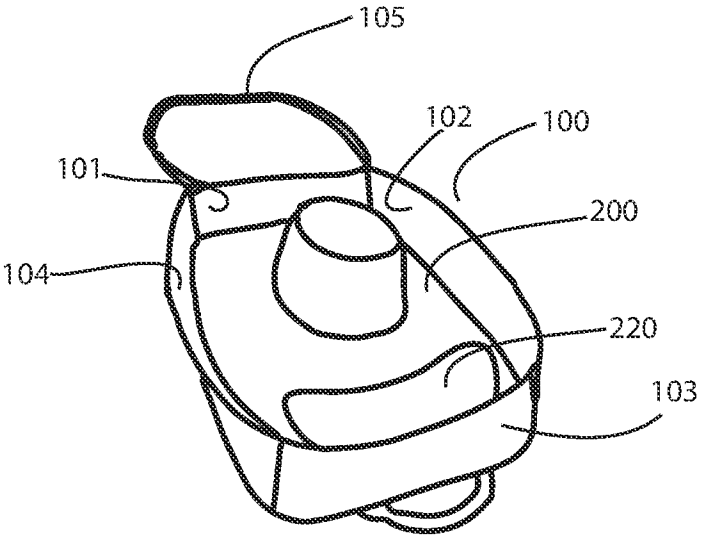
FIG. 12 conceptually illustrates an exemplary backpack with an open hat compartment according to principles of the invention.
Figure 14:
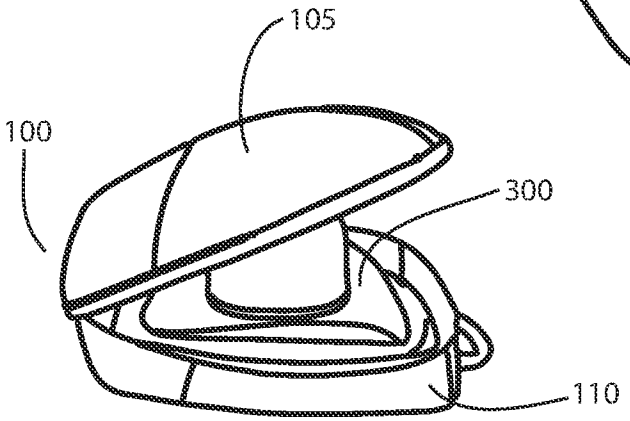
FIG. 14 conceptually illustrates an exemplary backpack with a partially closed hat compartment containing a hat according to principles of the invention.

FIG. 12 conceptually illustrates an exemplary backpack 100 with an open hat compartment according to principles of the invention. The tray 200 is inserted into the compartment. The compartment is defined by the substantially rigid cover 105 and the substantially rigid base defined by sides 101-104. In FIG. 13 a hat 300 is placed in the compartment on the tray 200, with the mandrel 205 nested in the dome of the hat 300, and the dipped front of the brim contained in the recess 220. In FIG. 14, the substantially rigid cover 105 is being closed. When closed, the hat is contained and protected in the compartment between the tray 200 and the outer cover 105. The dipped front brim of the hat 300 is not deformed, but rather is contained within the recess 220. Removal of the hat 330 is accomplished by opening the cover 105 and lifting the hat 300 off the tray 200.

A multipurpose carrier according to principles of the invention may be comprised of various materials known in the art of luggage, backpacks, duffle bags and the like. Rigid elements may be comprised of a relatively hard moldable thermoplastic, such as, but not limited to, ethylene-vinyl acetate copolymer (EVA). Rigid components may be covered with a cloth, nylon, leather or other flexible and lightweight material. Other components (e.g., pockets and compartments) may be formed of lightweight flexible fabrics and panels of such materials.

While an exemplary embodiment of the invention has been described, it should be apparent that modifications and variations thereto are possible, all of which fall within the true spirit and scope of the invention. With respect to the above description then, it is to be realized that the optimum relationships for the components and steps of the invention, including variations in order, form, content, function and manner of operation, are deemed readily apparent and obvious to one skilled in the art, and all equivalent relationships to those illustrated in the drawings and described in the specification are intended to be encompassed by the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

What is claimed is:

1. A multipurpose carrier for a western hat, the multipurpose carrier comprising: a hat compartment, a hat tray and an additional compartment, the hat compartment comprising a base and a cover, the base being substantially rigid and the cover being substantially rigid, and the base defining a cavity, the cavity being sized and shaped to receive the tray, and the cover covering the cavity, and the cover being movable from an open position to a closed position; the tray comprising a panel, a mandrel and a recess, the panel having a top, a bottom, a front edge, a back edge, a first side and a second side, the mandrel being an upright formation extending from top of the panel between the front edge and the back edge, and the recess comprising a depressed area formed in the top of the panel, between the mandrel and the front edge, adjacent to the front edge, and extending substantially from the first side of the panel to the second side of the panel, the depressed area being sized, shaped and positioned to receive a dipped front edge of a brim of a western hat; further comprising an enclosure extending from the bottom of the tray, the enclosure being substantially rigid, having a u-shaped cross section shape and defining the additional compartment between the enclosure and the bottom of the tray.

2. The multipurpose carrier of claim 1, the recess having a depth below the top of the panel of about 10 to 35 mm.

3. The multipurpose carrier of claim 1, the mandrel having a frustum shape.

4. The multipurpose carrier of claim 3, further comprising a resilient cover over the mandrel.

5. The multipurpose carrier of claim 4, the mandrel having a maximum height of about 65 to 85 mm.

6. The multipurpose carrier of claim 3, further comprising a resilient band around the mandrel.

7. The multipurpose carrier of claim 3, the mandrel having a maximum diameter of 180 to 220 mm.

8. The multipurpose carrier of claim 3, the mandrel having a maximum height of about 65 to 85 mm.

9. The multipurpose carrier of claim 1, the back of the enclosure and the front of the enclosure being open to allow access to the additional compartment.

10. The multipurpose carrier of claim 9, further comprising an access opening and closure being aligned with at least the back of the enclosure or the front of the enclosure.

11. A backpack carrier for a western hat, the carrier comprising: a hat compartment and a hat tray, the hat compartment comprising a base and a cover, the base being substantially rigid and the cover being substantially rigid, and the base defining a cavity, the cavity being sized and shaped to receive the tray, and the tray being removable from the compartment, and the cover covering the cavity, and the cover being rigid and movable from an open position to a closed position; the tray comprising a panel and a mandrel, the panel having a top, a bottom, a front edge, a back edge, a first side and a second side, the mandrel being an upright formation extending from top of the panel between the front edge and the back edge; and backpack shoulder straps coupled to the base; further comprising a pocket extending from the bottom of the tray.

12. The backpack carrier for a western hat according to claim 11, the tray further comprising a recess, the recess comprising a depressed area formed in the top of the panel, between the mandrel and the front edge, adjacent to the front edge, and extending substantially from the first side of the panel to the second side of the panel, the depressed area being sized, shaped and positioned to receive a dipped front edge of a brim of a hat.

13. A backpack carrier containing a hat, the hat including a dome and a brim, the backpack carrier comprising: a hat compartment, a hat tray and an additional compartment, the hat compartment comprising a base and a cover, the base being substantially rigid and the cover being substantially rigid, and the base defining a cavity, the cavity being sized and shaped to receive the tray, and the cover covering the cavity, and the cover being rigid and movable from an open position to a closed position, the hat; the tray comprising a panel, and a mandrel, the panel having a top, a bottom, a front edge, a back edge, a first side and a second side, the mandrel being an upright formation extending from top of the panel between the front edge and the back edge; and the hat being on the tray in the hat compartment, with the dome of the hat receiving the mandrel and the brim of the hat being suspended above the panel; and the backpack carrier including shoulder straps coupled to the base; further comprising a pocket extending from the bottom of the tray.

14. The backpack carrier containing a hat of claim 13, wherein the brim of the hat includes a front edge, the front edge being dipped, and the tray further comprising a recess, the recess comprising a depressed area formed in the top of the panel, between the mandrel and the front edge, adjacent to the front edge, and extending substantially from the first side of the panel to the second side of the panel, and the recess receiving the front end of the brim of the hat, the depressed area being sized, shaped and positioned to receive a dipped front edge of a brim of the hat.

15. The backpack carrier containing a hat of claim 13, the mandrel having a frustum shape and being sized and shaped to be received in the dome of the hat.

16. The backpack carrier containing a hat of claim 13, further comprising a resilient material on the mandrel.

17. The backpack carrier containing a hat of claim 13, further comprising an access opening and closure being aligned with the pocket.

* * * * *